US007261247B2

(12) United States Patent
Yeh et al.

(10) Patent No.: US 7,261,247 B2
(45) Date of Patent: Aug. 28, 2007

(54) SLIP GEAR FOR GEARED SPRINKLER MOTOR

(75) Inventors: Jonathan Yeh, Chino, CA (US); Bradley D. Helzer, Ontario, CA (US)

(73) Assignee: Rain Bird Corporation, Azusa, CA (US)

( * ) Notice: Subject to any disclaimer, the term of this patent is extended or adjusted under 35 U.S.C. 154(b) by 278 days.

(21) Appl. No.: 10/988,925

(22) Filed: Nov. 15, 2004

(65) Prior Publication Data

US 2006/0108446 A1 May 25, 2006

(51) Int. Cl.
*B05B 3/04* (2006.01)

(52) U.S. Cl. ..... 239/237; 239/240; 239/203; 239/263.3; 239/263; 239/202

(58) Field of Classification Search ..... 239/203, 239/204, 205, 206, 237, 240, 241, 263, 263.3
See application file for complete search history.

(56) References Cited

U.S. PATENT DOCUMENTS 4,892,252 A * 1/1990 Bruninga ..... 239/205
4,901,924 A * 2/1990 Kah, Jr. ..... 239/242
5,048,757 A 9/1991 Van Leeuwen
5,115,977 A 5/1992 Alkalay et al.
5,383,600 A 1/1995 Verbera et al.
5,511,727 A * 4/1996 Heren et al. ..... 239/242
5,676,315 A * 10/1997 Han ..... 239/590
5,695,122 A * 12/1997 Messinger ..... 239/240
5,695,123 A 12/1997 Le
5,758,827 A * 6/1998 Van Le et al. ..... 239/242
5,938,122 A 8/1999 Heren et al.
6,042,021 A 3/2000 Clark
6,050,502 A 4/2000 Clark
6,840,460 B2 * 1/2005 Clark ..... 239/205
6,869,026 B2 * 3/2005 McKenzie et al. ..... 239/237
2002/0153432 A1 10/2002 McKenzie et al.
2002/0179733 A1 * 12/2002 Clark ..... 239/203

* cited by examiner

*Primary Examiner*—Kevin Shaver
*Assistant Examiner*—Trevor McGraw
(74) *Attorney, Agent, or Firm*—Fitch, Even, Tabin & Flannery

(57) ABSTRACT

A slip-clutch assembly including a slip gear and clutch for a sprinkler motor of a sprinkler is disclosed for reducing damage to movable portions of the sprinkler is disclosed. The slip-clutch assembly allows at least a portion of a motor assembly or a sprinkler head to rotate at a rate lower than under normal operating conditions. The slip-clutch assembly includes a first component or portion with deformable portions received under normal operating conditions within recesses or cooperating structure of a second component or portion. The deformable portions are able to release or slip from the cooperating structure when the rotation of a portion of the sprinkler is impeded by a force exceeding a predetermined level. The deformable portions of the slip-clutch assembly may include deflectable arms with an engageable portion received within the cooperating structure. The engageable portion may dis-engage by camming out of the cooperating structure when the impeding force exceeds the predetermined level.

22 Claims, 19 Drawing Sheets

SLIP GEAR FOR GEARED SPRINKLER MOTOR

FIELD OF THE INVENTION

The invention relates to a rotating sprinkler and, in particular, to a gear mechanism for rotating a portion of a sprinkler including cooperating portions that allow the mechanism to slip when rotation is resisted.

BACKGROUND OF THE INVENTION

Currently, many types of sprinklers are known and utilized for distributing water to a desired area such as for watering plants, crops, and lawns. Some sprinklers are generally stationary and deliver water to a predetermined area dependent on the direction to which one or more outlets, such as nozzles, are pointed. Many sprinklers rely on a portion that moves relative to a stationary or fixed base portion so that the water is distributed to a particular area intermittently as water is distributed to a different area.

For instance, some sprinklers rotate back and forth so, at a particular moment, a first area receives a certain amount of water while another receives less and, at a subsequent moment the first area receives less than the other area. Other sprinklers include a portion that includes one or more nozzles that rotate or sweep over a particular area so that, again, different areas receive water intermittently.

One type of sprinkler is known as a motor driven sprinkler. Though there are many types of these, one example utilizes a turbine placed in the water stream. When the water stream strikes the turbine, the water forces the turbine to rotate in a predetermined direction based on vanes or vaned portions located on the turbine. The rotation of the turbine then drives a portion of the sprinkler including a nozzle in a rotary fashion. Thus, the rotation of the turbine effects the rotation of the nozzle for distributing water in a radial fashion, and portions of the surrounding area receives water for the period of time in which a spray or stream of the nozzle is directed at the surrounding area portions.

Many motor driven sprinklers are pop-up sprinklers. A pop-up sprinkler is a sprinkler having a case or housing that is generally stationary relative to the ground, and a riser that is in a retracted position when the sprinkler is shut off and is extended when the sprinkler is activated by turning the water on. The riser reciprocates between the retracted and extended position within an internal cavity of the housing so that a nozzle located on the riser is free to distribute water when the riser is extended, while typically being located within the housing when the riser is retracted.

In a motor driven pop-up sprinkler, the riser includes a sprinkler head portion that rotates relative to the riser when in the extended position and activated. The riser contains a motor assembly which is connected to the sprinkler head such that the sprinkler head is driven around by the motor assembly. In many cases, this motor assembly utilizes the described turbine.

In use, the sprinkler head rotates upon the activation of water. Therefore, the sprinkler head rotates as the riser is extending from the housing, when the sprinkler head is extended, and as the sprinkler head is retracting as the water flow is diminishing before the water flow ceases. During this time, particulate matter may come in contact with and between the sprinkler head and the riser body. Such particulate matter may cause binding between the sprinkler head and the riser body.

In addition, people often grab onto the extended and rotating sprinkler head. This may be done by a person who is trying to adjust a setting on the sprinkler head or is trying to examine the sprinkler head. At times, the sprinkler head is held by a person with negative intentions, such as a vandal.

In the event the sprinkler head is held stationary or bound so that it is prevented from rotating, damage can occur to the sprinkler head. The components utilized between the motor and the sprinkler head operate in a wet environment, and using steel, for example, is often not beneficial to the life of the sprinkler head. On the other hand, the plastic or polymer components often used are typically not strong enough to halt the rotation of the motor assembly, such as the turbine in the water stream. The force of the water is great enough that the turbine continues to spin, and the internal components between the turbine and the sprinkler head can strip each other.

Accordingly, there has been a need for an improved motor assembly for preventing damage to a sprinkler head when rotation is impeded.

DESCRIPTION OF THE PREFERRED EMBODIMENT

Figure 1:
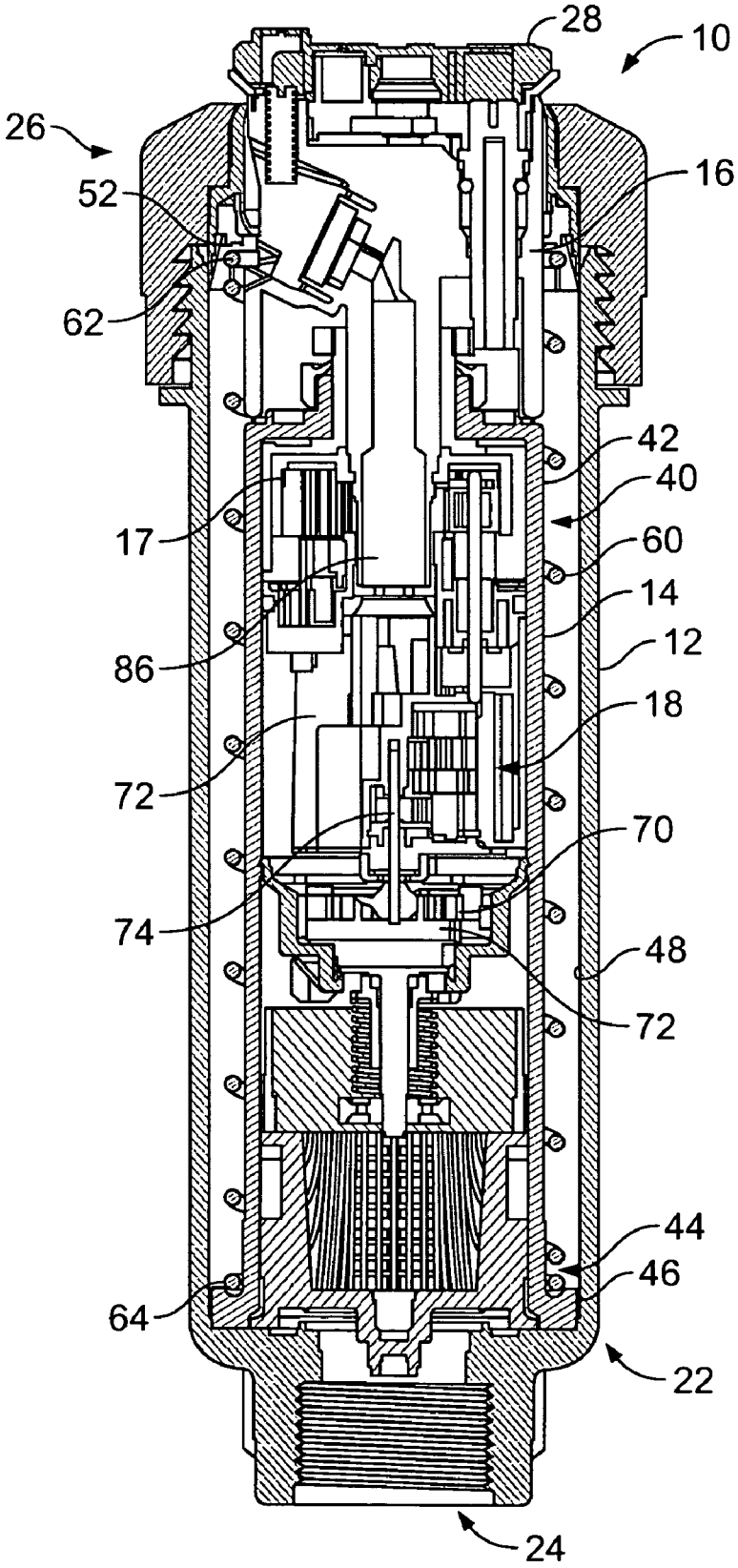
FIG. 1 is a side elevational cross-sectional view of a pop-up sprinkler with a rotating sprinkler head including a motor assembly including a slip gear in accordance with an aspect of the present invention.
Figure 2:
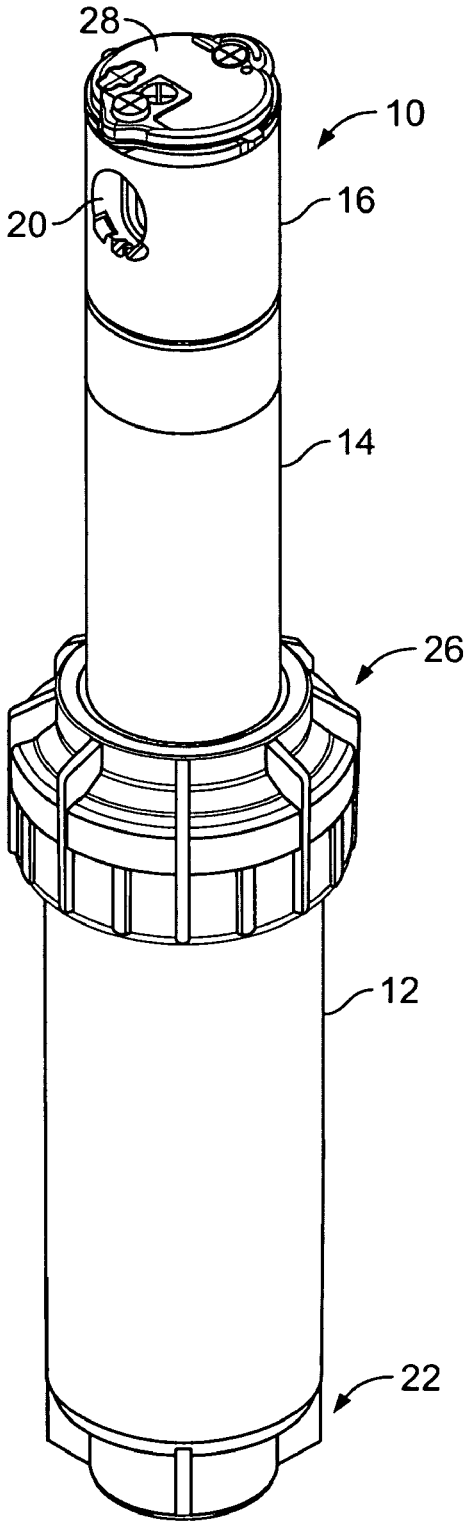
FIG. 2 is a perspective view of the pop-up sprinkler with a riser and sprinkler head in an extended position for distributing water therefrom.

Referring initially to FIGS. 1 and 2, a pop-up sprinkler 10 is depicted having a housing 12, a riser 14, a rotating sprinkler head 16, and a motor assembly 18. As will be discussed herein, the motor assembly 18 includes a turbine 70 located in the water flow stream. During use, the turbine 70 rotates at a rate in the order of 1890 revolutions per minute (RPMs), while the sprinkler head 16 preferably rotates approximately 1 revolution per minute.

Where the rotation of the sprinkler head 16 is impeded by, for instance, a person holding the sprinkler head 16 stationary when the sprinkler 10 is activated, some portion of the motor assembly 18 must account for this stress. As the power delivered by the water stream on the turbine 70 is often too great for the turbine 70 to be stopped, the stress may be borne by components deforming, gears of the motor assembly 18 shearing teeth, or gears fixedly attached to axles slipping around the axles.

To provide a non-destructive, high-life cycle mechanism for responding to impedance of the rotation of the sprinkler head 16, the motor assembly 18 is provided with a slip-clutch assembly, as will be described below. In simple terms, the slip-clutch assembly replaces one of the components of the motor assembly with a pair of components which, when a threshold level of stress is experienced, slip relative to each other until the stress is relieved. Once the impedance ceases, the pair of components re-engage, and the sprinkler 10 continues to operate normally.

The housing 12 has a lower end 22 with an inlet 24 that is threaded to connect to a pipe (not shown) for delivering water to the sprinkler 10 from a water source (not shown). The sprinkler 10 may be one of a number of sprinklers 10 connected to an irrigation network for distributing water over a particular area and including controls for activating and shutting off the water supply.

In use, the sprinkler 10 is generally embedded into ground or soil for distributing water to an area surrounding the sprinkler 10, and an upper end 26 of the housing 12 is generally at ground or grade level. The sprinkler 10 has a retracted position, shown in FIG. 1, and an extended position represented in FIG. 2. When the water is shut off, the riser 14 and the sprinkler head 16 are in the retracted position and generally located within the housing 12 so that a top surface 28 of the sprinkler head 16 is generally just above the ground level.

The housing 12 is generally cylindrical and defines a cavity 40 therein, and the riser 14 has a generally cylindrical outer surface 42. The riser 14 has a lower end 44 with an annular shoulder 46 extending thereabout. In a preferred embodiment, the shoulder 46 includes notches (not shown) for receiving ribs (not shown) located on an inner surface 48 of the housing 12. The notches cooperate with the ribs so that the riser 14 shifts generally linearly within the housing 12 between the retracted and extended positions.

The sprinkler 10 includes a bias member in the form of a coil spring 60 having an top coil 62 that contacts an inner shoulder 52 of the housing 12, as can be seen in FIG. 1. The spring 60 further includes a bottom coil 64 that contacts the riser ratchet shoulder 46. When the water is shut off, the spring 60 biases the riser 14 and sprinkler head 16 towards the retracted position.

Activation of the water into the housing 12 causes the riser 14 to extend from the housing 12. The extended riser 14 allows the sprinkler head 16 and a nozzle 20 located thereon to be exposed, and water is directed in the direction of the nozzle 20. The upward shifting of the riser 14 in response to water pressure compresses the spring 60 between the riser shoulder 46 and the housing inner shoulder 52. When the water is shut off, the spring 60 directs the riser 14 to return to its original, retracted position.

During activation with the riser 14 extended, water flows through the riser 14 and causes the sprinkler head 16 to rotate. Broadly stated, the water flowing through the riser 14 drives the motor assembly 18 to rotate the sprinkler head 16. Specifically, the water strikes a turbine 70 located in a water passage 72 and connected to an axle 74. The turbine 70 rapidly rotates, such as in the order of 1890 RPMs. The axle 74 is connected to a first of a series of reduction gears of a gear assembly 80 of the motor assembly 18. The gear assembly 80 reduces the rotation so that the sprinkler head 16 rotates at approximately 1 RPM. This conversion or reduction results in a great deal of torque for driving the sprinkler head 16.

Figure 3:
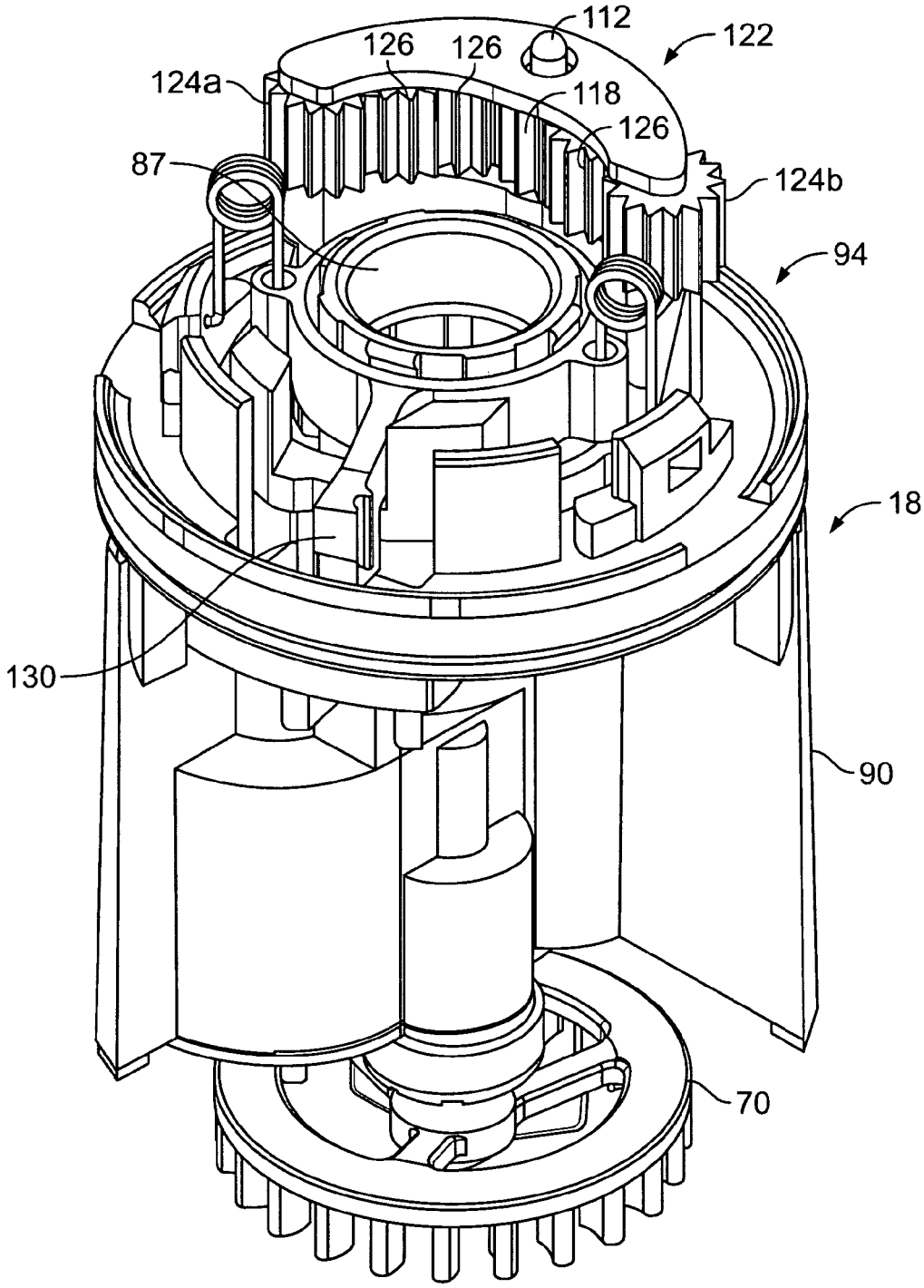
FIG. 3 is a perspective view of a motor assembly for rotating the sprinkler head relative to the riser showing a turbine, a motor housing, and a direction assembly.
Figure 4:
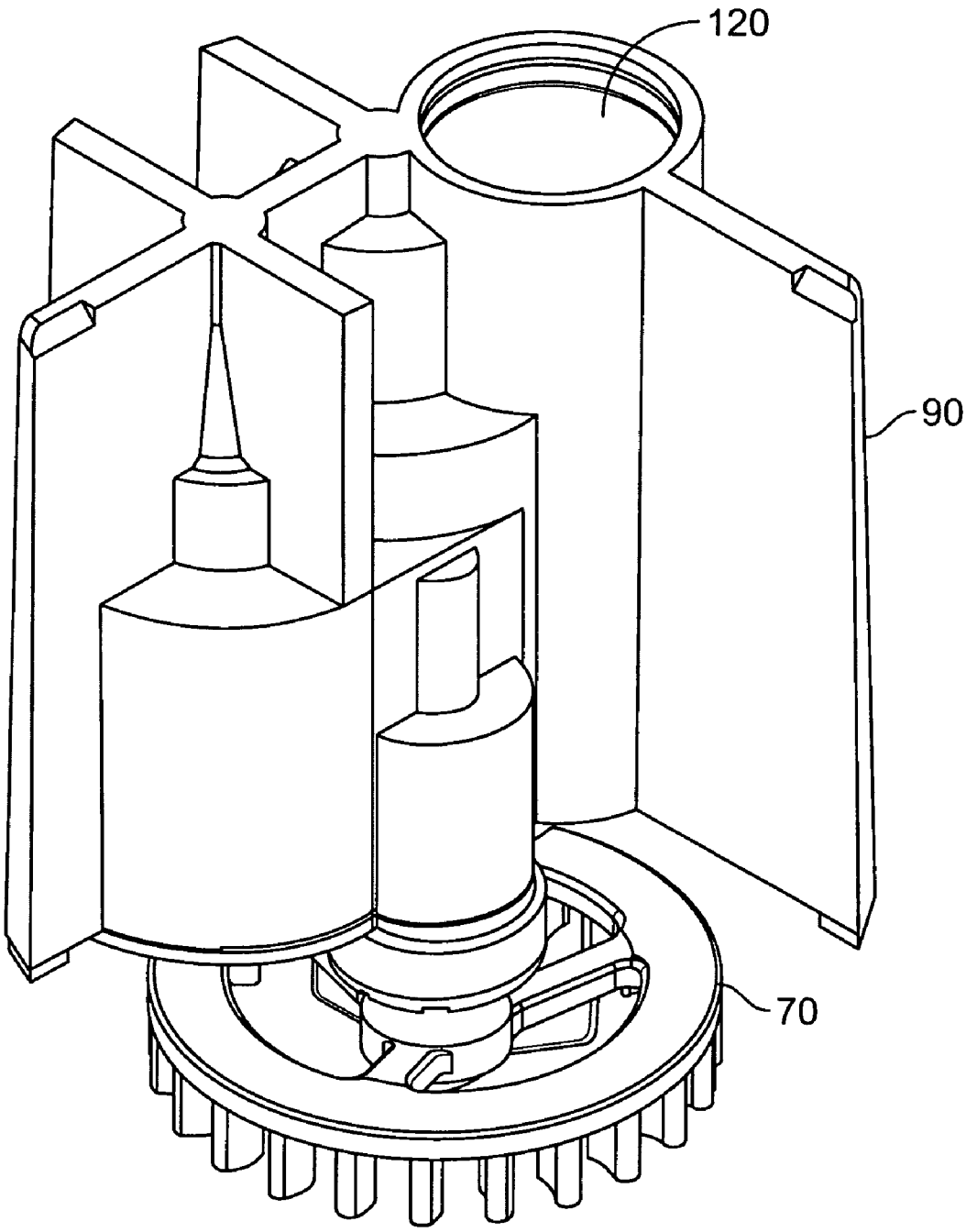
FIG. 4 is a perspective view of the turbine and the motor housing showing an opening for cooperating with the direction assembly.

The sprinkler head 16 has a central axle 86 around which it rotates relative to the riser 14. The central axle 86 is generally cylindrical and communicates with the riser water passage 72 to receive water therethrough. The water is then delivered to the nozzle 20 for emission from the sprinkler head 16. As can be seen in FIG. 3, the central axle 86 is received in a port 87 in a direction assembly 94 of the motor assembly 18.

The sprinkler head 16 includes gearing 17 for engaging the motor assembly 18, as will be discussed below. In this manner, the motor assembly 18 converts the energy and force of the water striking the turbine 70 into rotational force and torque for rotating the sprinkler head 16.

Referring now to FIGS. 3 to 6, the motor assembly 18 of the sprinkler head 16 is depicted. The motor assembly 18 includes the turbine 70, a motor housing 90, the reduction gear assembly 80 located within the motor housing 90, and a direction assembly 94. The turbine 70 is connected to a lower portion 76 of the axle 74 such that the turbine 70 and axle 74 rotate together. An upper portion 78 of the axle 74 includes a pinion gear 79 that also rotates with the turbine 70 and axle 74.

The gear assembly 80 utilizes a plurality of paired gears 100 to communicate the rotation of the turbine 70 to the direction assembly 94. Each paired gear 100 has a larger lower portion 102 and a smaller upper portion 104 that rotate together freely around an axle 106. Both portions 102 and 104 of each paired gear 100 include gear teeth 105. However, the lower portion 102 has significantly more teeth 105 than the upper portion 104. Each paired gear 100 is mated and cooperates with another paired gear 100 so that the smaller upper portion 104 of a paired gear 100 cooperates with the larger lower portion 102 of a subsequent paired gear 100. In this manner, a single rotation of a larger lower portion 102 is effected by a plurality of rotations of a smaller upper portion 104.

The pinion gear 79 mates with a first paired gear 100*a* of the gear assembly 80. The pinion gear 79 is relatively small in comparison to the larger lower portion 102*a* of the first paired gear 100*a* and, accordingly, a plurality of rotations of the turbine 70 and pinion gear 79 is required to rotate the first paired gear 100*a* a single revolution. In this manner, the high revolutions per minute of the turbine 70, noted above, are reduced with a consequent increase in torque.

Figure 5:
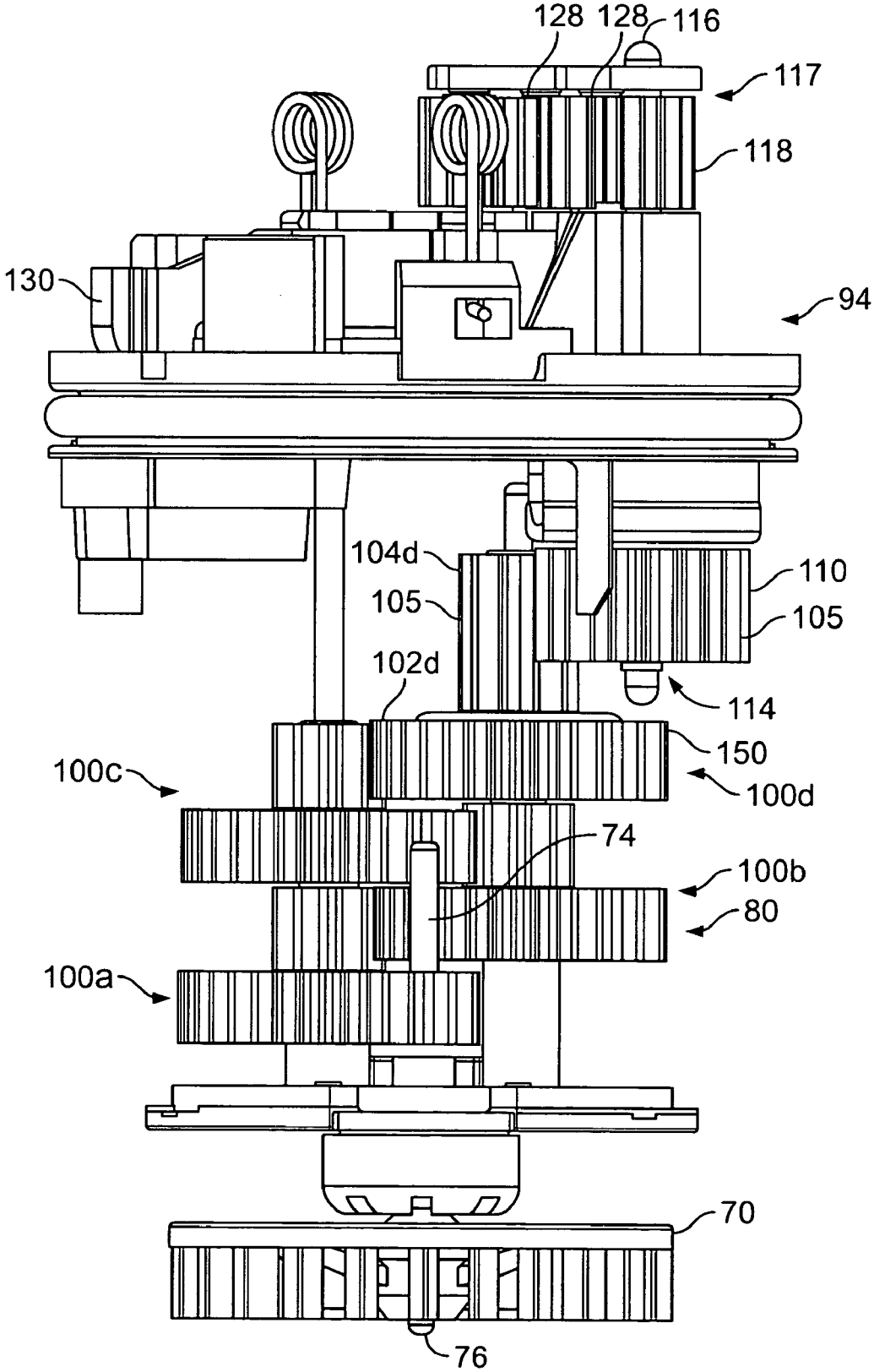
FIG. 5 is a side elevational view of the turbine and the direction assembly and a gear assembly of the motor assembly.
Figure 6:
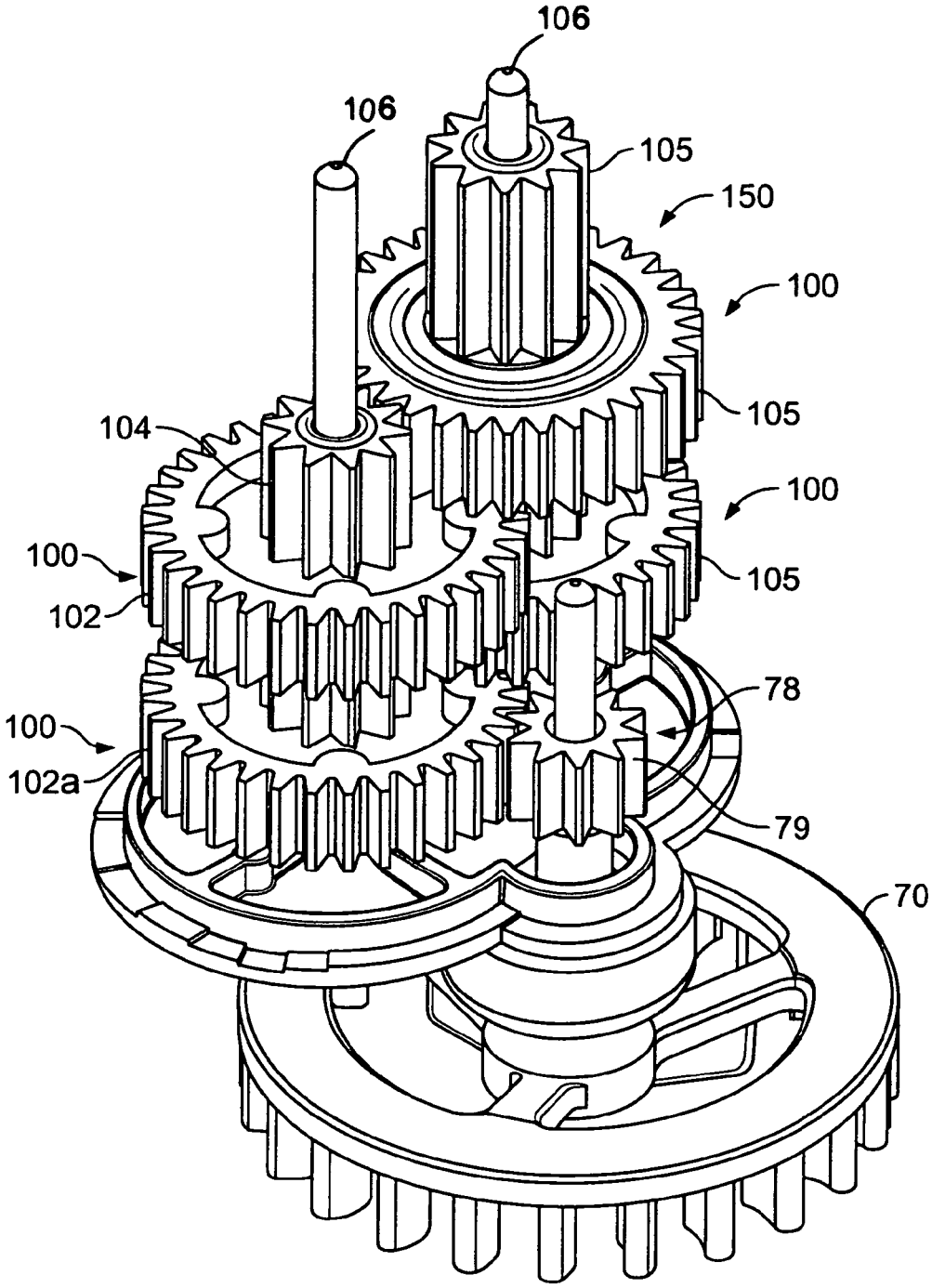
FIG. 6 is a perspective view of the gear assembly and the turbine.
Figure 7:
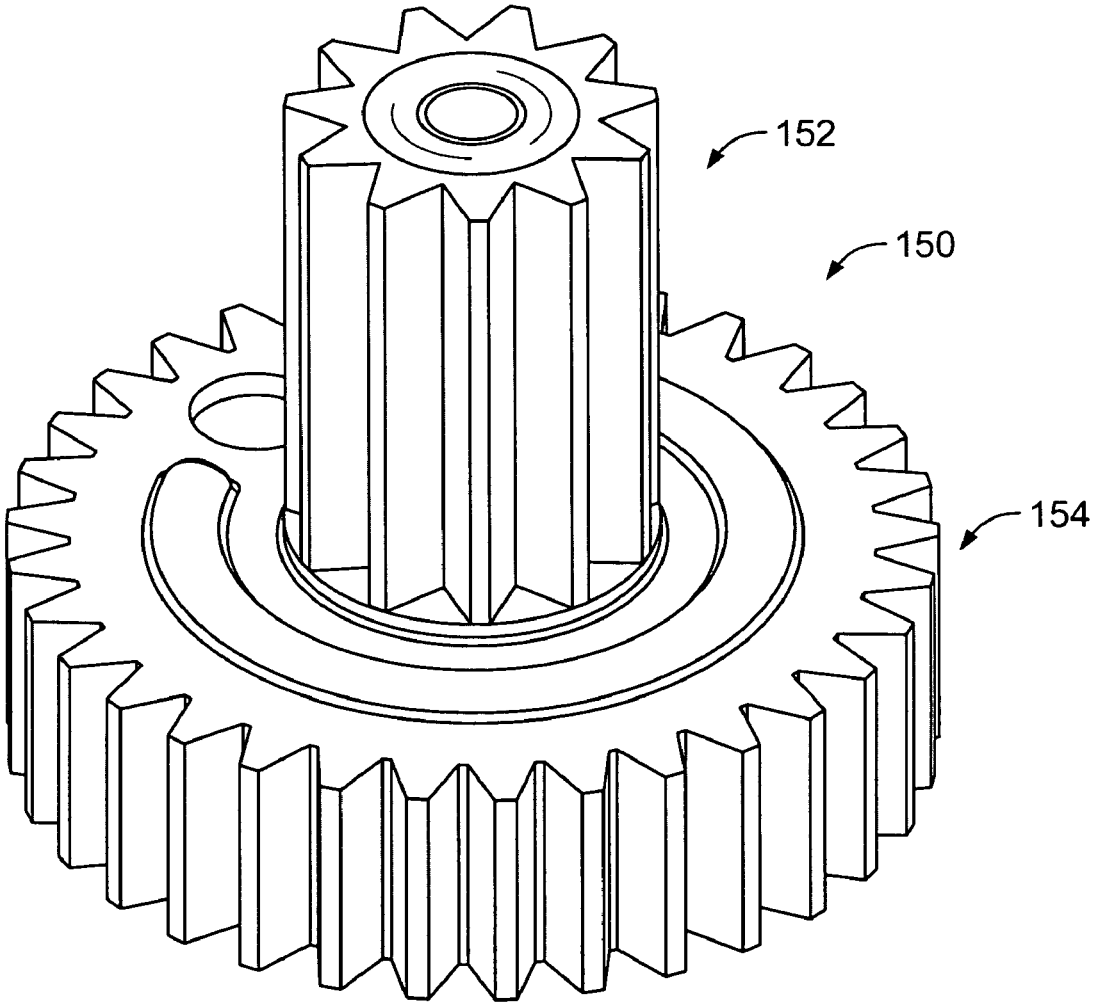
FIG. 7 is a perspective view of a slip-clutch assembly of the gear assembly showing a ratchet gear extending through and received in a sleeve gear.
Figure 8:
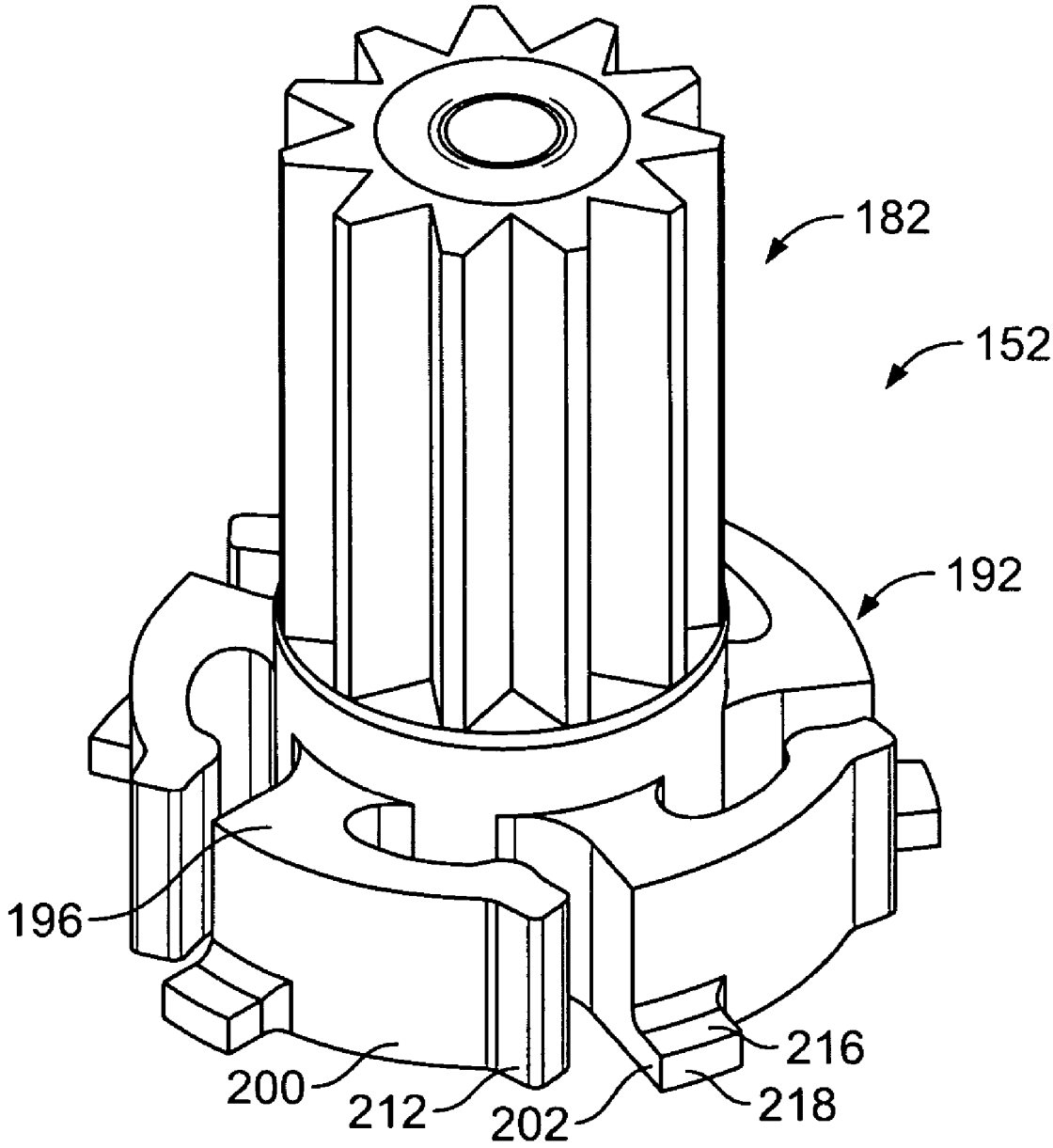
FIG. 8 is a perspective view of the ratchet gear showing a plurality of ratchet legs extending about a periphery of a lower portion of the ratchet gear.
Figure 9:
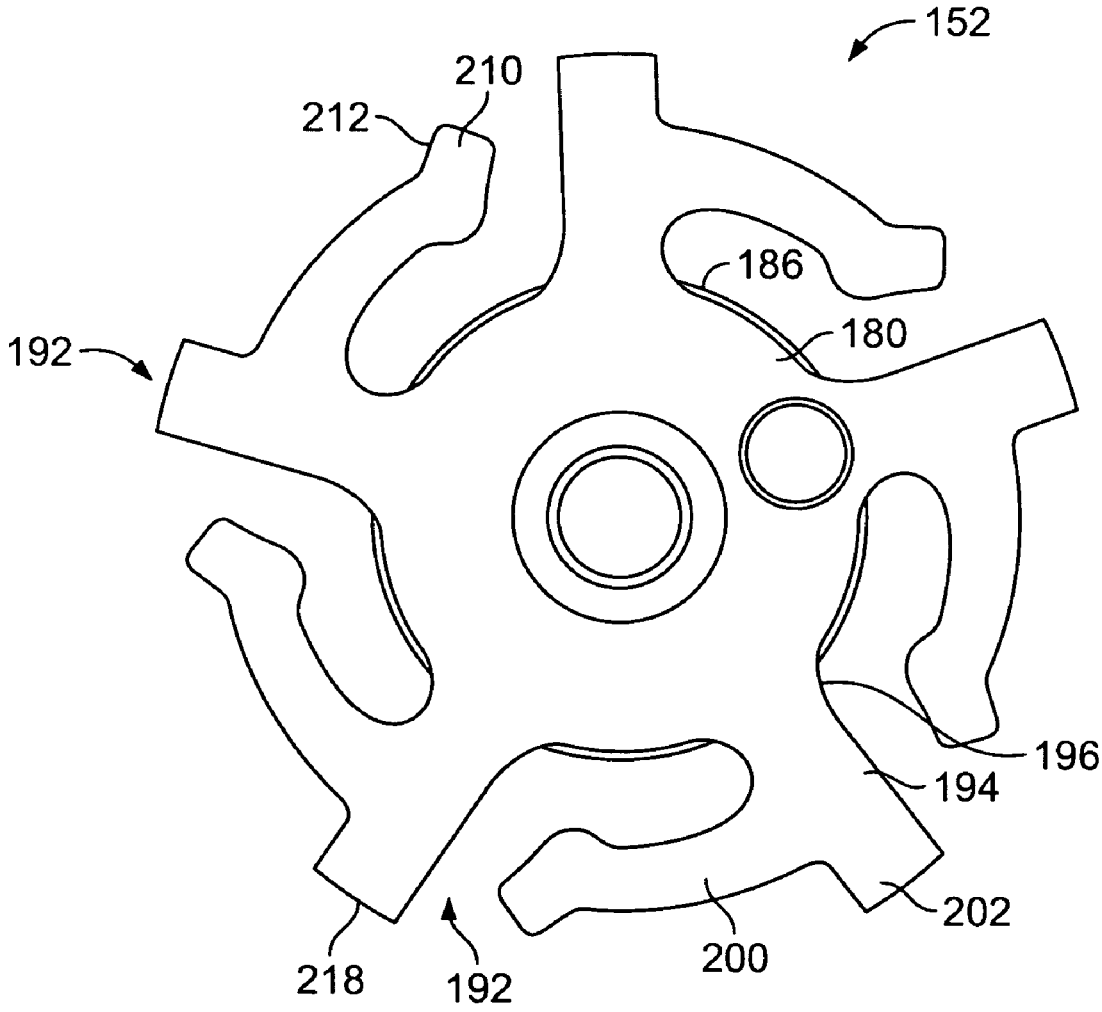
FIG. 9 is a bottom plan view of the ratchet gear.
Figure 10:
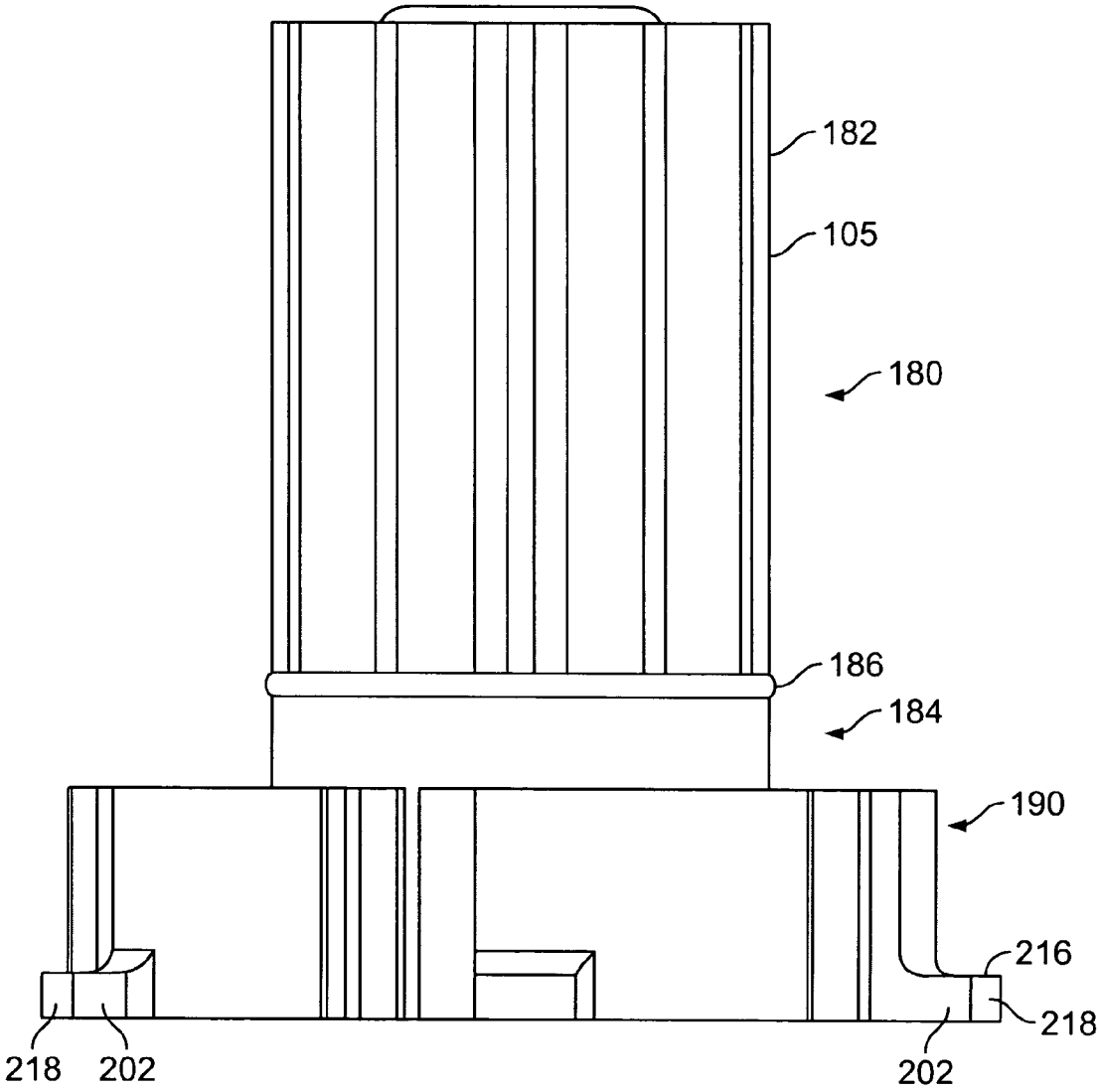
FIG. 10 is a side elevational view of the ratchet gear.
Figure 11:
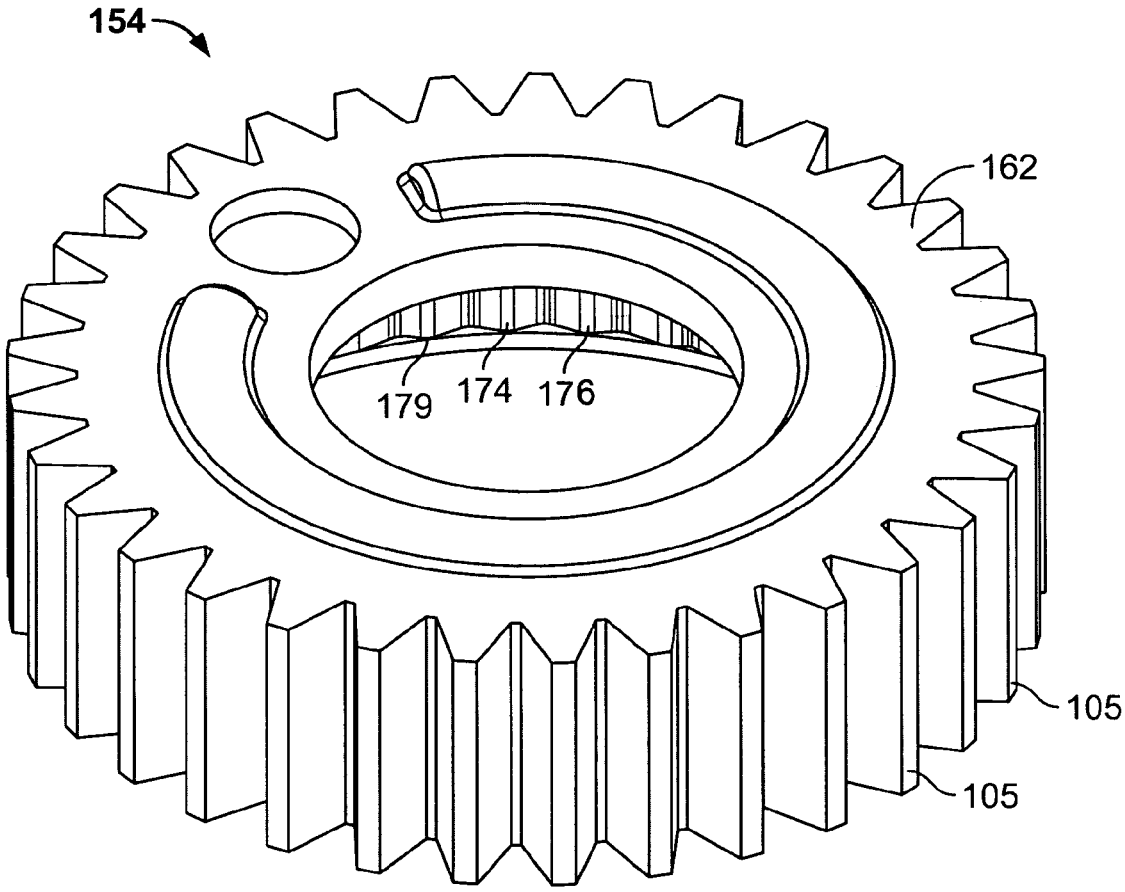
FIG. 11 is a perspective view of the sleeve gear showing an opening through which the ratchet gear is received.
Figure 12:
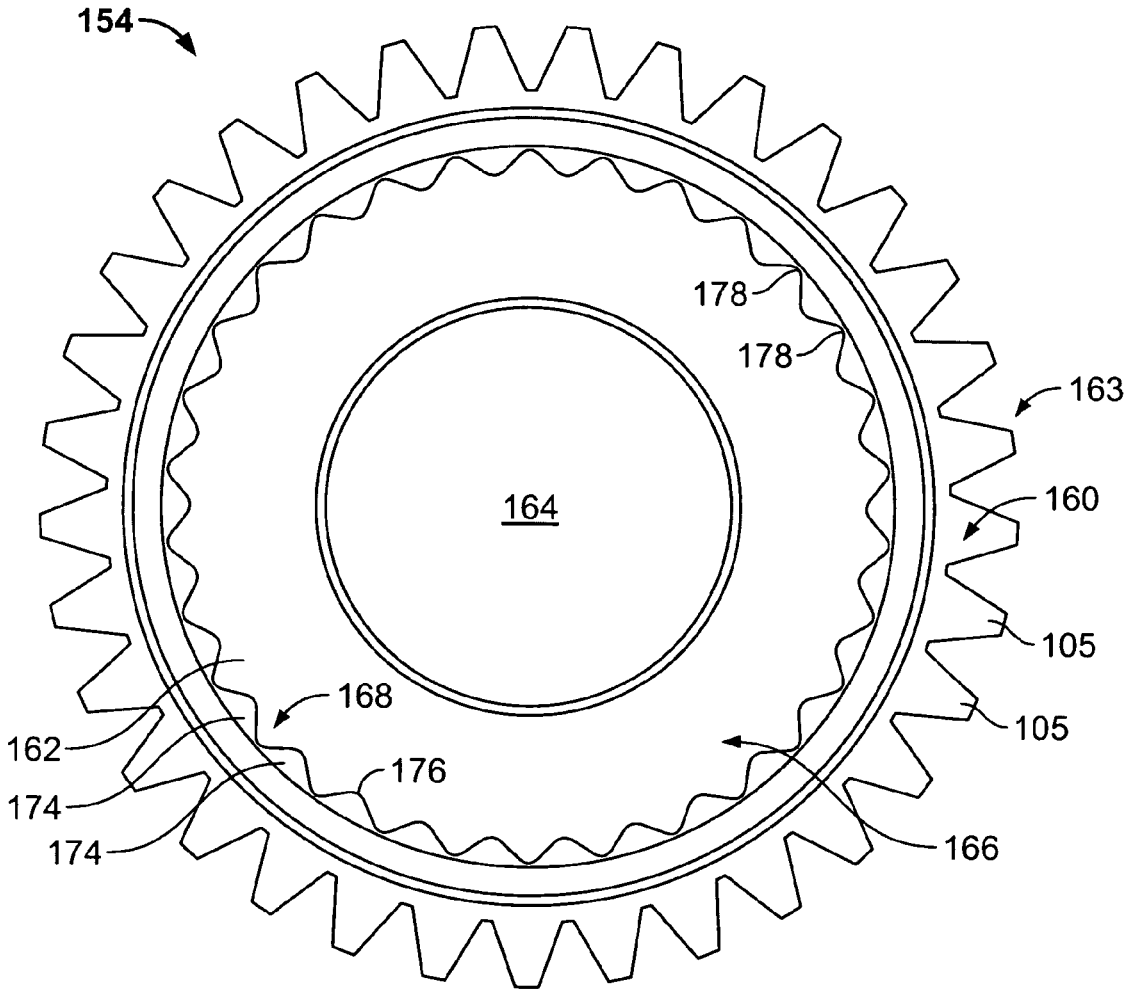
FIG. 12 is a bottom plan view of the sleeve gear showing ratchet teeth for cooperating with the ratchet legs of the ratchet gear.

The gear assembly 80, as depicted, includes four paired gears 100*a*, 100*b*, 100*c*, and 100*d*. The paired gear 100*d* cooperates with a direction assembly pinion gear 110, as can be seen in FIG. 5, to transmit the drive from the turbine 70 to the direction assembly 94.

The direction assembly pinion gear 110 is non-rotationally secured to an axle 112 at an axle lower portion 114. An upper portion 117 of the axle 116 includes a distribution gear 118. The pinion gear 110 is received within an opening 120 in the motor housing 90 (see FIG. 4) so that teeth 105 on the pinion gear 110 are mated with teeth 105 on the upper portion 104*d* of the fourth paired gear 100*d*. Thus, the power of the turbine 70 is transmitted through to the direction assembly 94.

The direction assembly 94 includes a rotation sub-assembly 122. The rotation sub-assembly 122 cooperates with the gearing 17 located on a portion of the sprinkler head 16 (see FIG. 1) so that the rotation sub-assembly 122 directly effects rotation of the sprinkler head 16. The rotation sub-assembly 122 includes the distribution gear 118 which communicates with two drive gears 124 via intermediate gears 126. Rotation of the distribution gear 118 causes the other gears 124, 126 to rotate around axles 128. However, each gear 118, 124, 126 rotates in a direction counter to any gear with which it is mated. In the present embodiment, two intermediate gears 126 are communicate between the distribution gear 118 and a first drive gear 124*a*, while one intermediate gear 126 communicates between the distribution gear 118 and a second drive gear 124*b*. Accordingly, rotation in a particular direction by the distribution gear 118 causes the drive gears 124 to rotate in opposite directions.

The direction assembly 94 includes a lever 130 that is moved between two positions so as to adjust the position of the rotation sub-assembly 122 relative to the sprinkler head 16. In a first position, the first drive gear 124*a* is mated with the sprinkler head gearing 17 to effect rotation of the sprinkler head 16 in a first direction and the second drive gear 124*b* is disengaged from the sprinkler head gearing 17. In the second position, the first drive gear 124*a* is disengaged from the sprinkler head gearing 17 and the second drive gear 124*b* is engaged so that the sprinkler head 16 is rotated in a second, opposite direction.

As discussed above, the revolutions per minute of the turbine 70 are in the order of 1890 RPMs, and the sprinkler head 16 rotates at approximately 1 RPM. To respond to rotational impedance of the sprinkler head 16, the motor assembly 18 is provide with a slip-clutch assembly including a two or more components which are able to slip when a threshold level of stress is experienced and re-engage once the impedance is removed.

The slip-clutch assembly may be incorporated into any of the gears of the motor assembly 18. However, the further down-line from the turbine 70 the slip-clutch assembly is located, the greater its efficacy. For instance, if the slip-clutch assembly were incorporated into pinion 79 connected to the turbine 70, a single revolution prevented by a stationary sprinkler head 16 would require the pinion 79 to slip enough times to provide for approximately 1890 revolutions of the turbine 70. In contrast, if the slip-clutch assembly were incorporated at a subsequent gear in the motor assembly 18, the slips required for a missed rotation of the sprinkler head 16 would be reduced by the amount that the rotations had been reduced by the motor assembly rotation reduction.

In the preferred embodiment, the fourth paired gear 100*d* is provided as a slip-clutch assembly 150, as depicted in FIGS. 5-14 with particular emphasis on FIGS. 7-14. The slip-clutch 150 includes a sleeve gear 154 and a ratchet gear 152 received by the sleeve gear 154. The sleeve gear 154 includes recesses or troughs 178 that, ratchet-like, cooperate with arms 192 of the ratchet gear 152 to permit unidirectional movement between the sleeve gear 154 and the ratchet gear 152. As will be discussed in greater detail below, the arms 192 are able to deflect inward to cam in and out of the troughs 178.

The sleeve gear 154 includes a generally annular ring 160 and an annular top plate portion 162. An external surface 163 of the ring 160 includes gear teeth 105 corresponding to the gear teeth of lower portion 102 of a paired gear 100. The plate portion 162 includes a central opening 164 that is circular and has a center co-axial with the sleeve gear 154. Within the ring 160 is a cavity 166, and the ratchet gear 152 is received within the cavity 166 and through the opening 164, as will be discussed below.

An internal surface 168 of the ring 160 is stepped to form an upper portion 170 and a lower portion 172. The upper portion 170 has inwardly extending ridges or ratchet teeth 174 formed within the ring 160 evenly spaced around and thereon. The ratchet teeth 174 define peaks 176 and troughs 178 for receiving portions of the ratchet gear 152, as will be discussed. The lower portion 172 is relatively smooth and has a diameter equal to that of the troughs 178 of the upper portion 170. Accordingly, a radially extending shoulder 179 is formed between the upper and lower portions 170, 172.

The ratchet gear 152 includes a central portion 180 that is generally cylindrical. The central portion 180 has an upper portion 182 including teeth 105 corresponding to gear teeth of the upper portion 104 of a paired gear 100.

The central portion 180 further has an intermediate portion 184 that includes a protruding circumferential rib 186 located a short distance below the geared upper portion 182. To assemble the slip-clutch assembly 150, the upper portion 182 is inserted into the opening 164 of the sleeve gear 150. The intermediate portion 184 is sized so as to closely match the diameter of the opening 164 while permitting rotation relative thereto. The protruding rib 186 is larger than the size of the intermediate portion 184, and consequently requires being forced through the opening 164 to secure the ratchet gear 152 with the sleeve gear 154.

The ratchet gear central portion 180 also has a lower portion 190 which is located in the cavity 166 of the sleeve gear 150. The lower portion 190 includes a series of arms 192 extending outward from the central portion 180 for cooperating with the ratchet teeth 174 of the sleeve gear 152. During normal operation, the arms 192 are engaged with the ratchet teeth 174 of the sleeve gear 152. When stress on the slip-clutch assembly 150 reaches a predetermined threshold in a particular direction due to impedance of the rotation of the sprinkler head 16, the arms 192 deflect inward so that they slip over the sleeve gear ratchet teeth 174, thus preventing damage to the sprinkler motor assembly 18.

Each arm 192 has a number of portions. The arm 192 includes a branch portion 194 extending in a radial direction from a base 196 at the central portion 180, a leg portion 200 extending circumferentially from the branch portion 194, and a foot portion 202 extending co-linearly from the branch portion 194 and radially from the central portion 180. Each branch 194 is generally secured and, preferably, formed integral with the central portion 180.

Figure 13:
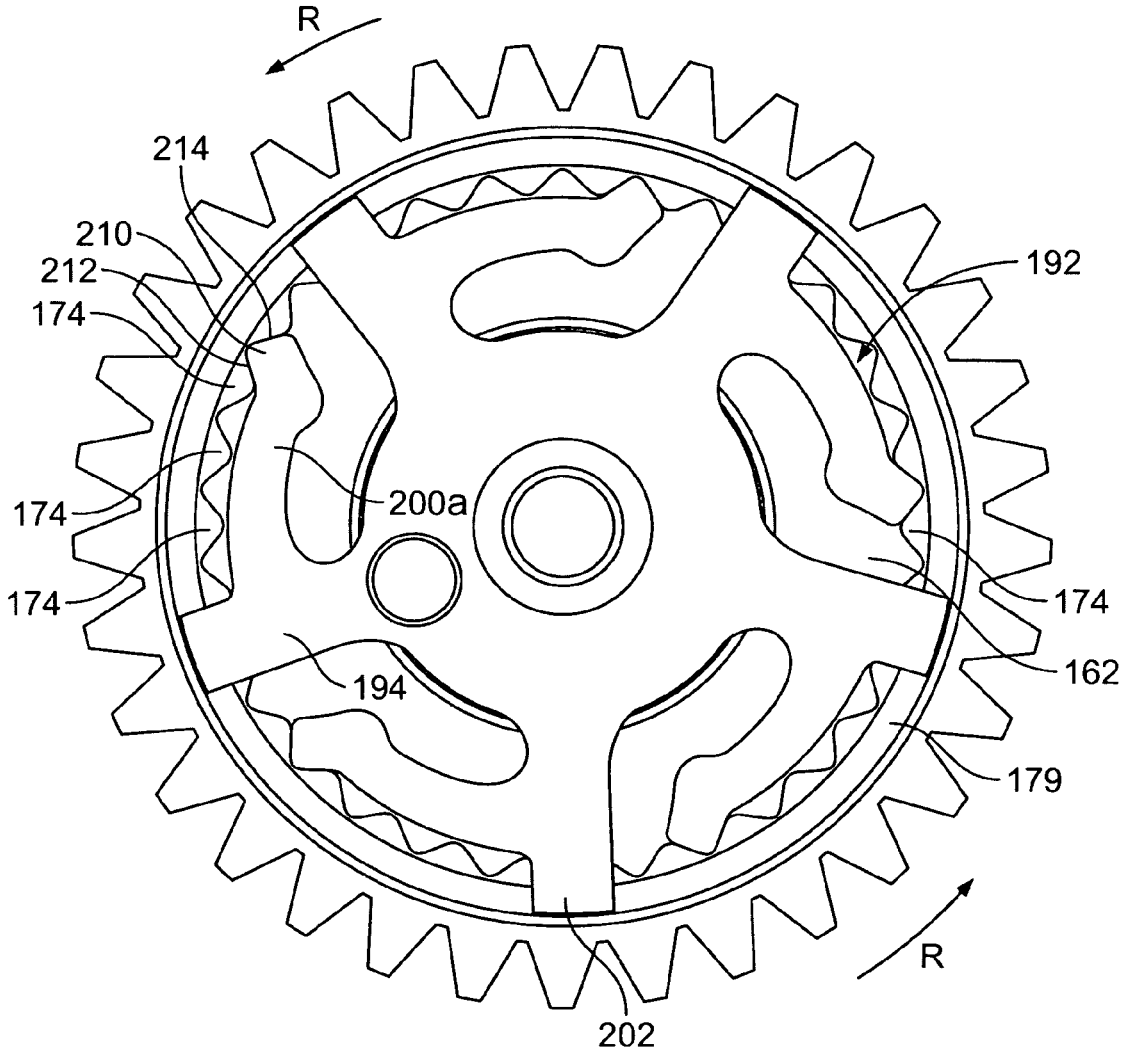
FIG. 13 is a bottom plan view of the ratchet legs of the ratchet gear cooperating with the ratchet teeth of the sleeve gear, and showing radial arms on the ratchet gear cooperating with an annular stepped collar on the sleeve gear for maintaining the ratchet gear and sleeve gear in a coaxial relationship.
Figure 14:
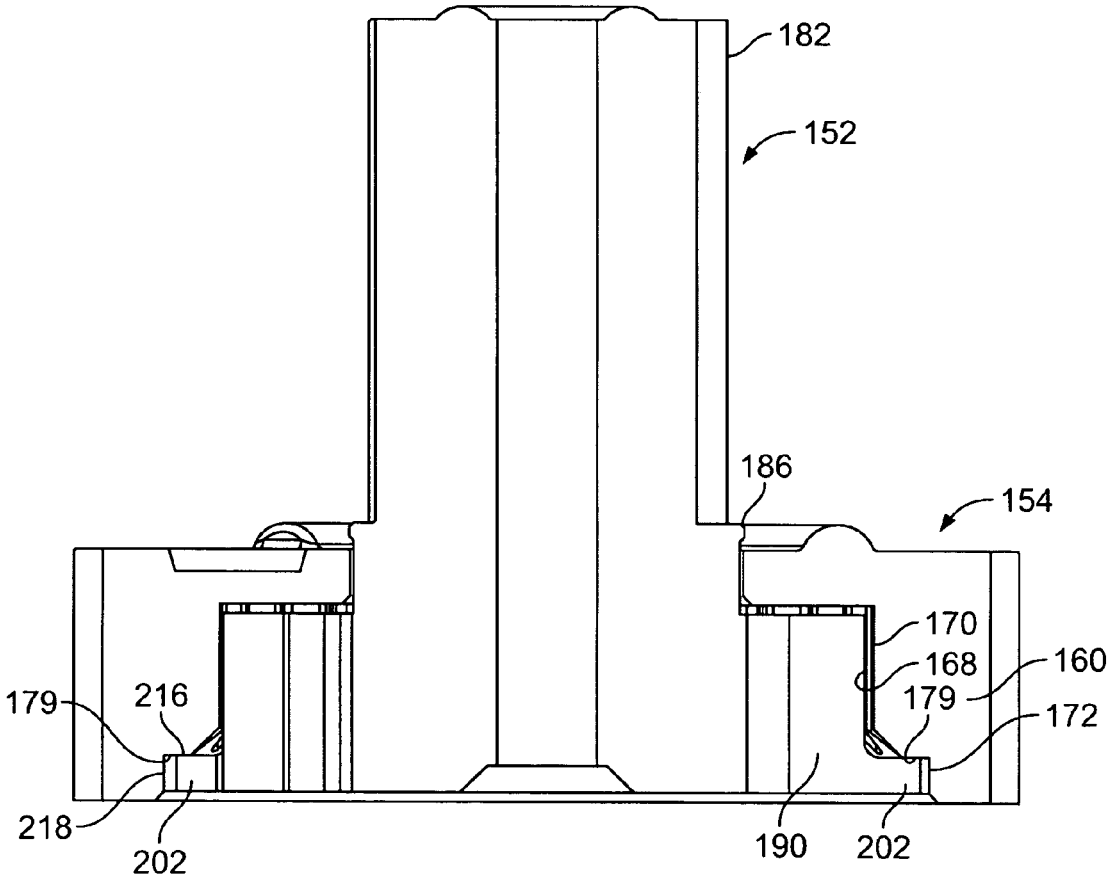
FIG. 14 is a cross-sectional view of the slip-clutch assembly showing the radial arms positioned against the stepped collar and showing a snap-fit connection between the ratchet gear and sleeve gear.
Figure 15:
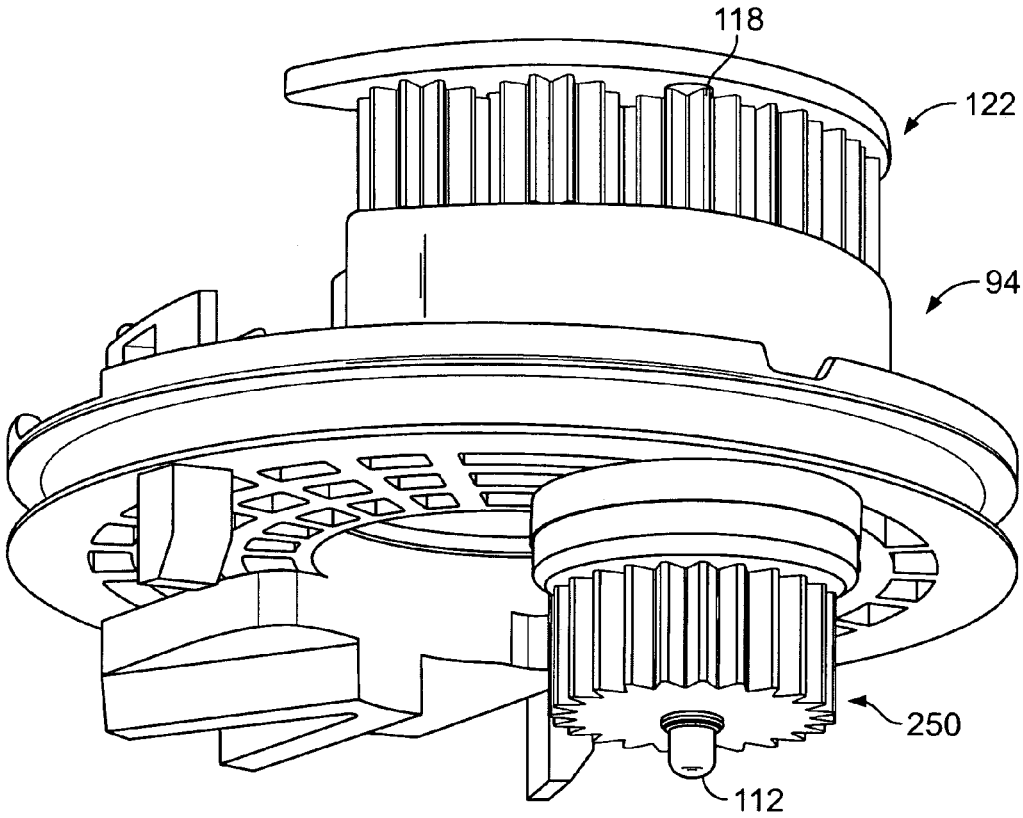
FIG. 15 is a perspective view of the bottom of the direction assembly showing a drive gear received within the opening of the motor housing of FIG. 4.
Figure 16:
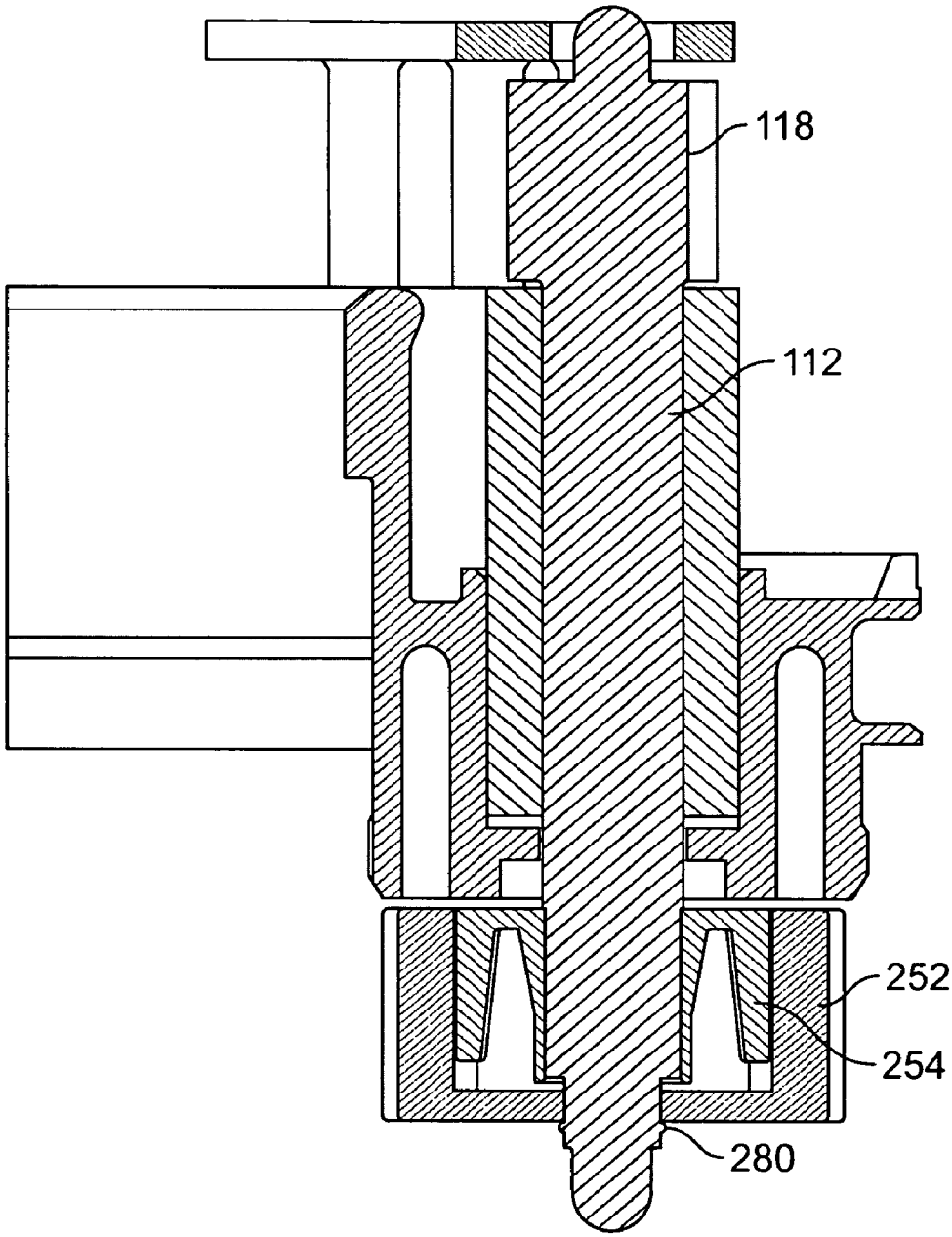
FIG. 16 is a cross-sectional view of an alternative embodiment slip-clutch assembly being formed on the drive gear.
Figure 17:
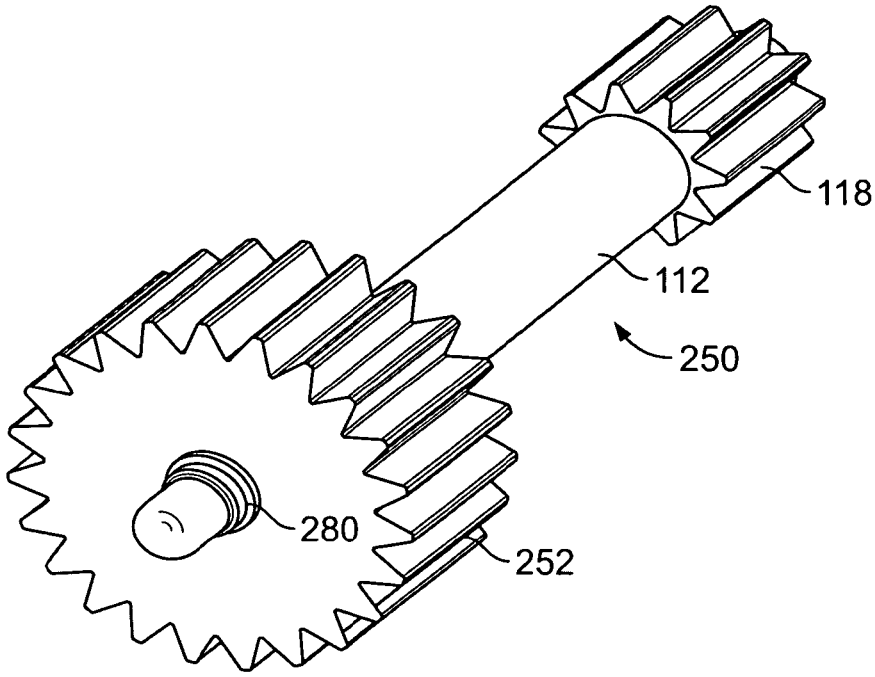
FIG. 17 is a perspective view of the drive gear.
Figure 18:
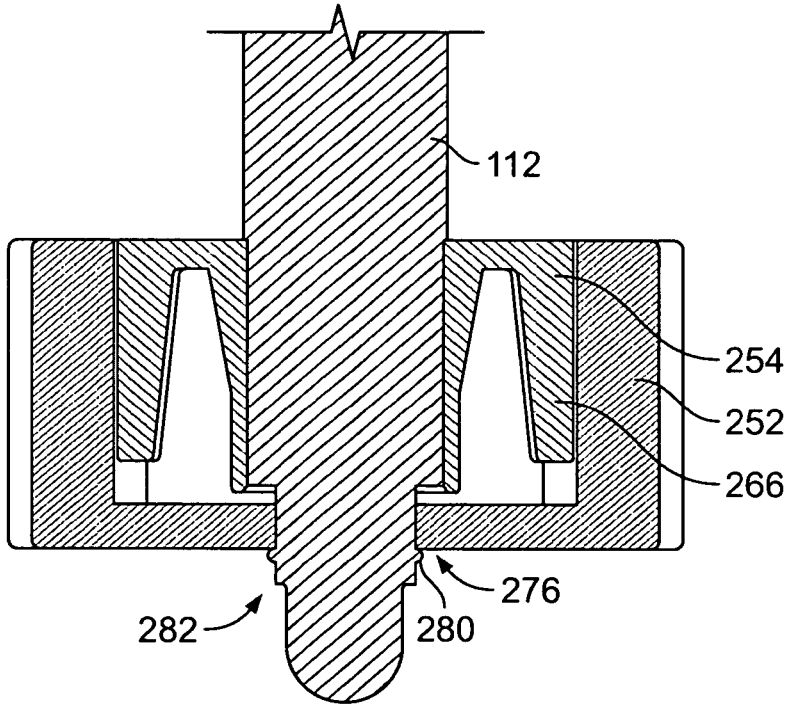
FIG. 18 is a fragmentary cross-sectional view of the drive gear showing a slip gear positioned within a clutch gear.
Figure 19:
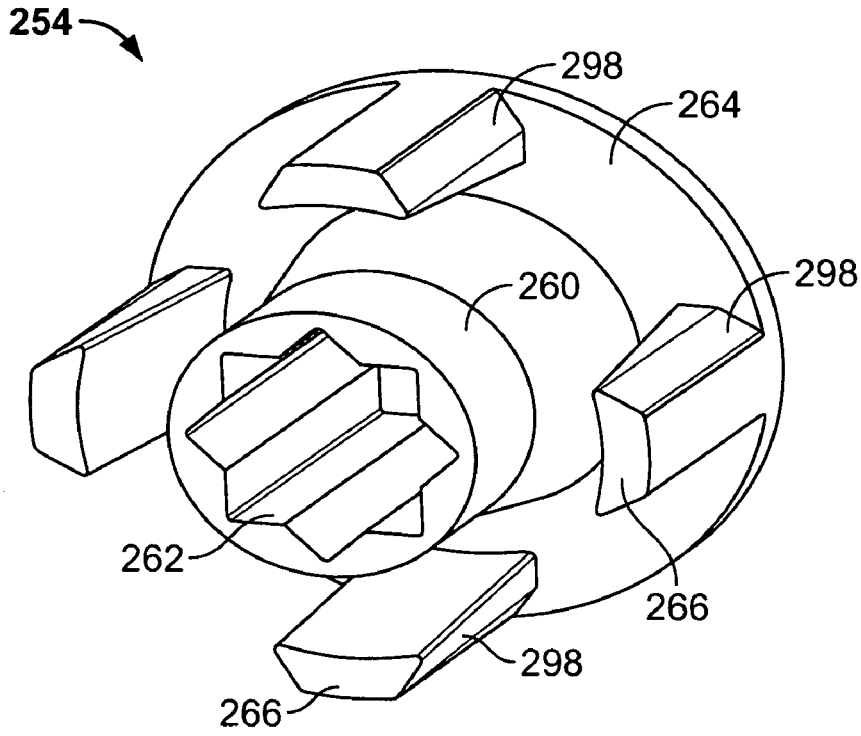
FIG. 19 is a perspective view of the slip gear showing slip fingers and a central opening for non-rotationally receiving an axle.
Figure 20:
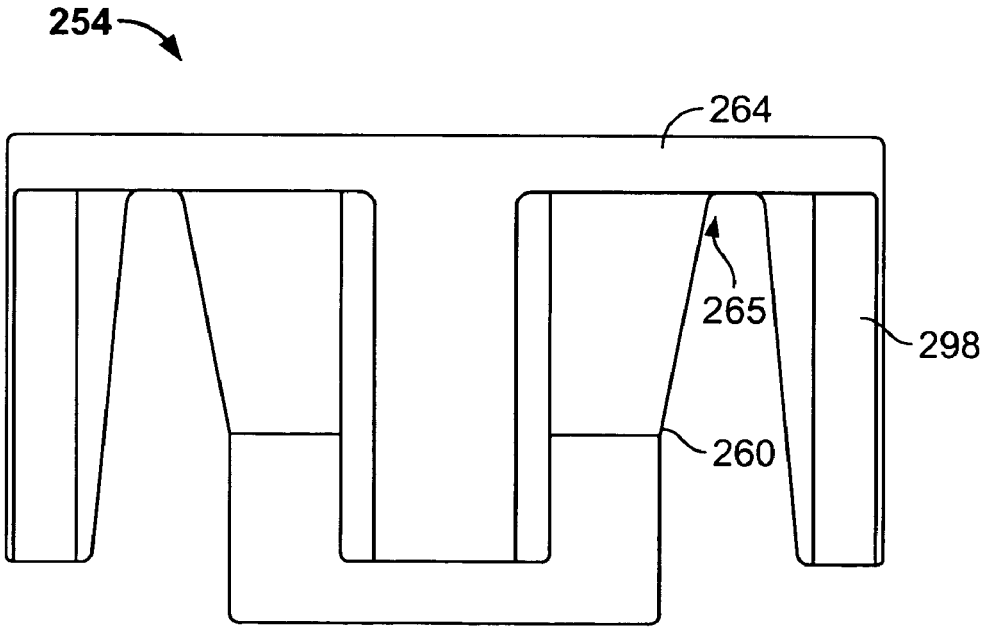
FIG. 20 is a side elevational view of the slip gear.
Figure 21:
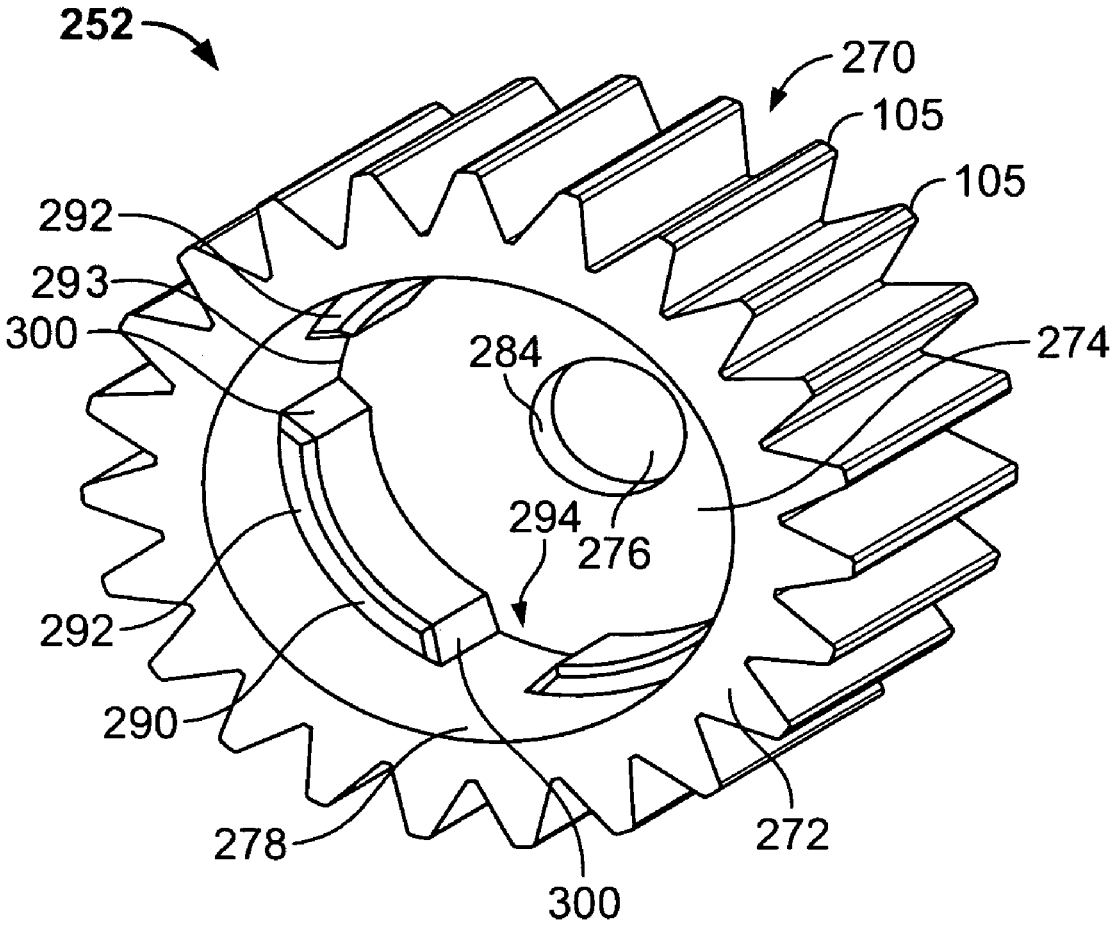
FIG. 21 is a perspective view of the clutch gear showing structure for cooperating with the slip fingers of the slip gear.

In the event the arm 192 is deflected inward, it is preferred that the leg portion 200 principally deform. In this manner, the circumferentially extending leg 200 need only deform a small amount to disengage from the ratchet teeth 174. More specifically, each leg 200 has a toe 210 having a first surface 212 generally formed in plane that is skewed outward from the leg 200. With reference to FIG. 13, when the ratchet gear 152 is rotated relative to the sleeve gear 154 in the direction of arrow R, the first surface 212 cams over the ratchet teeth 174 as the leg 200 deflects inward. The toe 210 furthermore has a second surface 214 set at approximately 90° inward from the first surface 212. In this manner, if the ratchet gear 152 were to attempt to rotate counter to the direction of arrow R, the leg 200 would not deflect as easily as the forces are generally resolved as a compression force on the leg 200. However, this counter-rotation would be in the direction that the turbine 70 is rotating due to the force of the water and, hence, would not likely be met with significant resistance. In other words, the arrow R represents the direction of rotation of the ratchet gear 152 rotates relative to the sleeve gear 154 when slipping, and the counter direction is the drive direction. To promote the deformation due to deflection occurring principally in the leg 200, a central portion 200*a* is thinner than the rest of the leg 200 and thinner than the branch portion 194.

When stressed and torqued, gears will tend to deflect away from each other. This results in improper mating, higher stress, and oftentimes damage. Accordingly, it is desired to provide the ratchet gear 152 and sleeve gear 154 with cooperating structure to prevent the gears 152, 154 from tilting with respect to each other. Towards this end, the arm 192 is provided with the foot 202, as noted above. The foot 202 extends beyond the ratchet teeth 174 and to the lower portion 172 of the internal surface 168 of the sleeve gear ring 160. The foot 202 has a top surface 216 that abuts and slides against the shoulder 179 formed between the upper and lower portions 170, 172 of the ring internal surface 168, and has an end surface 218 that is slightly arcuate for abutting and sliding against the internal surface lower portion 170.

In this manner, the ratchet gear 152 and sleeve 154 are reinforced against any force between tending to cause a relative tilt therebetween. The combination of the radially extending branch 194 and foot 202 act as a spoke between the central portion 180 and the ring 160. In addition, the surface 216 and shoulder 179 cooperate so that any tilting would require the arms 192 to deflect downward.

As noted, it is preferred that the slip-clutch assembly 150 be provided as the fourth paired gear 100*d*. However, it should be noted that the greatest reduction ratio is experienced at the direction assembly pinion gear 110. Accordingly, the sprinkler 10 may alternatively be provided a slip-clutch assembly 250 as the direction assembly pinion gear 110.

Referring now to FIGS. 15-21, the slip-clutch assembly 250 is shown in the direction assembly 94. The slip-clutch assembly 250 includes a drive gear 252 and a slip gear 254, which is non-rotationally secured to the axle 112. More specifically, the slip gear 254 is provided with a hub 260 having a hub opening 262 (see FIG. 19) that is non-circular for receiving a portion of the axle 112 similarly configured. In this manner, rotation of the slip gear 254 necessitates rotation of the axle 112. As can best be seen in FIGS. 19 and 20, the slip gear 254 also includes a top plate portion 264 extending radially from a top portion 265 of the hub 260.

The drive gear 252 includes an external surface 270 including gear teeth 105, as described above for the direction assembly pinion gear 110. The drive gear 252 is similar to the sleeve gear 154 in that it has an annular ring 272 including the external geared surface 270 and a bottom plate 274 including an annular central opening 276 co-axial with the drive gear 252 itself. The ring 272 and bottom plate 274 define a cavity 278 into which the slip gear 254 is received, and the axle 112 is received in the opening 276 and a clip 280 is secured around a lower portion 282 of the axle 112 for retaining the drive gear 252 thereon. In addition, the opening 276 has an inner surface 284 that acts as a bushing against the axle 112, and the bushing 284 combines with the clip 280 to retard relative tilting between the drive gear 252 and the axle 112.

The slip gear 254 and drive gear 252 are provided with cooperating structure that allows the slip gear 254 to slip relative to the drive gear 252 when stress due to an impedance of the sprinkler head 16 rotation is exceeded. Specifically, a number of fingers 266 depend downward from the top plate 264 and are received by structure 290 located within the cavity 278 of the drive gear 252. The structure 290 is generally a series of circumferential walls sections 292 located at a shoulder 293 formed between the ring 272 and the bottom plate 274 of the drive gear 252. However, each wall section 292 is separated from an adjacent wall section 292 by a short gap 294 into which the slip gear fingers 266 are received.

Each finger 266 is provided with side surfaces 298 that are set at an angle inward from the outer circumference of the slip gear top plate 264. It is preferable that the angle be between 15° and 90°. The fingers 266 mate with the wall sections 292 in the gaps 294 therebetween, and these side surfaces 298 mate with similarly configured side surfaces 300 formed on the wall sections 292.

Under normal conditions, rotation of the drive gear 252 is transmitted to the slip gear 254 by driving the wall section side surfaces 300 against the finger side surfaces 298. When stress exceeds a predetermined level, the angled surfaces 298, 300 cam against each other, thereby forcing the fingers 266 to deflect inward. In this manner, the slip gear 254 and drive gear 252 are able to slip and relative to each other. When the stress is relieved, the fingers 266 return to a position located in the gaps 294 between the wall sections 292 to re-engage the slip and drive gears 254, 252.

It should be noted that the slip-clutch assembly may allow the turbine 70 and other components of the motor assembly 18 to rotate independently of the sprinkler head 16, which includes allowing the rates of rotation under normal conditions to be varied due to the impedance. This is particularly true considering that the slip-clutch assemblies disclosed herein utilize either friction or interference for transmitting power therethrough. Because the components of the slip-clutch assemblies remain generally in contact, this friction or interference is not completely removed. In this manner, the slip-clutch assembly re-engages very soon, if not immediately, after the impedance falls below the predetermined threshold level.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. A sprinkler for distributing water to an area proximately located thereto, the sprinkler comprising:

a stationary portion for connection to a water source;

an emission portion movable relative to the stationary portion for intermittently providing water to portions of the area; and a motor assembly for driving the emission portion relative to the stationary position and having a clutch assembly for preventing damage to the motor assembly, the clutch assembly including:

a first component including external structure for mating with a first portion of the motor assembly, and a second component including external structure for mating with a second portion of the motor assembly, wherein the first component and second component are stationary relative to each other and cooperate to transmit motion through the motor assembly during operation for driving the emission portion, and wherein at least one of the first and second components rotates relative to the other when an impedance force on the motor assembly exceeds a predetermined amount; and wherein the first component also includes at least one arm with a fixed end and an opposite free end wherein the free end engages the second component to transmit motion through the motor assembly during operation for driving the emission portion and is movable at least radially relative to the fixed end when an impedance force on the motor assembly exceeds a predetermined amount to allow at least one of the first and second components to rotate relative to the other.

2. The sprinkler of claim 1 wherein the motor assembly further includes a turbine located in a passageway through which water passes, and the turbine drives the motor assembly.

3. The sprinkler of claim 1 wherein the emission portion is generally rotatable relative to the stationary portion.

4. The sprinkler of claim 1 wherein the first component rotates about an axis of rotation and the at least one arm extends generally radially and circumferentially from the fixed end to the free end.

5. The sprinkler of claim 1 wherein the first component rotates about an axis of rotation and the at least one arm extends generally longitudinally from the fixed end to the free end.

6. The sprinkler of claim 2 wherein motor assembly further includes a gear reduction assembly, and the turbine transmits power to the gear reduction assembly.

7. The sprinkler of claim 6 wherein the clutch assembly transmits power to a reversible assembly for determining a direction of motion of the emission portion.

8. The sprinkler of claim 3 wherein the motor assembly includes a gear for contacting a geared portion of the emission portion for rotating the emission portion.

9. The sprinkler of claim 8 further including a riser, wherein the emission portion is a sprinkler head located on the riser and rotating relative thereto, and the stationary portion is a housing having an inlet connected to a water source.

10. In combination with a sprinkler having an inlet for receiving water from a water source, having a rotatable sprinkler head including an outlet for emitting the water, and having a fluid passageway between the inlet and the outlet, a motor assembly for driving the sprinkler head in at least one rotary direction comprising:

a turbine located in the fluid passageway that is rotated by a water stream flowing through the passageway;

a gear reduction assembly engaged with and driven by the turbine and including a series of gears;

an assembly engaged with and driven by the gear reduction assembly for driving the sprinkler head; and a clutch assembly engaged with the motor assembly so that when the rotation of the sprinkler head is impeded by a force exceeding a threshold, the clutch assembly allows the turbine to rotate independent of the sprinkler head;

wherein the clutch assembly includes:

a first portion having external gear teeth, and a second portion having external gear teeth, wherein the first portion is attached to the second portion so that the first and second portions rotate as one and operate as a single component under normal operating conditions, and the first and second portions may rotate relative to each other when the rotation of the sprinkler head is impeded;

wherein the first portion has an upper portion on which the external gear teeth are located, and a lower portion including resiliently deformable structure allowing the first portion to rotate relative to the second portion.

11. The combination of claim 10 wherein the second portion receives the deformable structure.

12. The combination of claim 11 wherein the second portion includes a ring defining a cavity within which the deformable structure is received.

13. The combination of claim 12 wherein the ring cooperates with the deformable structure to provide engagement with the deformable structure during normal operating conditions.

14. The combination of claim 13 wherein the ring includes recesses into which the deformable structure may be received during normal operation conditions to provide engagement therewith.

15. The combination of claim 14 wherein the deformable structure may dis-engage from the recesses when the sprinkler head is impeded.

16. The combination of claim 15 wherein the deformable structure may cam out of the recesses when the sprinkler head is impeded.

17. A motor assembly for driving a sprinkler head of a rotary sprinkler head in at least a first rotary direction, the motor assembly comprising:

a turbine located in a passageway through which water passes, and the force of the water drives the turbine in a rotational manner;

a drive assembly for driving the sprinkler head in at least a first rotary direction; and a clutch assembly engageable to transmit rotary motion from the turbine to the drive assembly during normal operating conditions and dis-engageable to allow at least a portion of the motor assembly to rotate at least at a lower rate than the sprinkler head when the sprinkler head is impeded by a force exceeding a predetermined amount;

wherein the clutch assembly includes:

a first portion including resiliently deflecting structure; and a second portion operationally engageable and dis-engageable by the deflecting structure;

wherein the deflecting structure includes extending arm portions at least partially received in cooperating structure of the second portion to provide engagement therebetween during normal operating conditions; and wherein the extending arm portions each includes a fixed end and a free end wherein the free end is movable at least radially relative to the fixed end when the sprinkler head is impeded by a force exceeding a predetermined amount to disengage from the cooperating structure of the second portion.

18. The motor assembly of claim 17 wherein the deformable structure deforms to permit disengagement from the second portion when the sprinkler head is impeded by a force exceeding the predetermined amount.

19. The sprinkler of claim 17 wherein the first portion rotates about an axis of rotation and each arm portion extends generally radially and circumferentially from the fixed end to the free end.

20. The sprinkler of claim 17 wherein the first portion rotates about an axis of rotation and each arm portion extends generally longitudinally from the fixed end to the free end.

21. The motor assembly of claim 18 wherein the deformable structure is located within and cooperates with a ring of the second portion.

22. The motor assembly of claim 18 wherein the arm portions may cam out of engagement with the cooperating structure when the sprinkler head is impeded by a force exceeding the predetermined amount.

* * * * *